US008041238B2

(12) United States Patent
Nagatsuka et al.

(10) Patent No.: US 8,041,238 B2
(45) Date of Patent: Oct. 18, 2011

(54) IMAGE FORMING APPARATUS, IMAGE FORMING METHOD, AND COMPUTER PROGRAM PRODUCT

(75) Inventors: Shingo Nagatsuka, Osaka (JP); Takuya Etoh, Osaka (JP); Yoshiko Ogawa, Tokyo (JP); Motohiro Kawanabe, Osaka (JP); Kimihiro Tanaka, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 426 days.

(21) Appl. No.: 12/410,815

(22) Filed: Mar. 25, 2009

(65) Prior Publication Data

US 2009/0245822 A1 Oct. 1, 2009

(30) Foreign Application Priority Data

Mar. 25, 2008 (JP) ..... 2008-077170

(51) Int. Cl.
*G03G 15/00* (2006.01)

(52) U.S. Cl. ..... 399/43; 399/49; 399/72

(58) Field of Classification Search ..... 399/38, 399/43, 46, 49, 72, 301–303, 308
See application file for complete search history.

(56) References Cited

U.S. PATENT DOCUMENTS

| | | | | |
|---|---|---|---|---|
| 7,610,004 | B2 * | 10/2009 | Kato et al. | 399/301 |
| 7,952,774 | B2 * | 5/2011 | Ikeda | 358/518 |
| 2003/0138261 | A1 * | 7/2003 | Tezuka et al. | 399/49 |
| 2007/0242986 | A1 * | 10/2007 | Matsuyama et al. | 399/301 |
| 2008/0038004 | A1 * | 2/2008 | Inoue | 399/45 |
| 2008/0279599 | A1 | 11/2008 | Nagatsuka | |

FOREIGN PATENT DOCUMENTS

| | | |
|---|---|---|
| JP | 2007-133356 | 5/2007 |

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A patch-pattern forming unit causes an image forming unit to form a patch pattern including a plurality of patches on a conveying member. A detecting unit detects the patch pattern formed on the conveying member. An adjusting unit adjusts an image forming condition of the image forming unit based on a result of detection by the detecting unit. The patch pattern has a length substantially equal to a distance between a patch-pattern start position, which is located at a space corresponding to at least a predetermined margin of a recording medium from a position of the image, and a position of the detecting unit.

15 Claims, 14 Drawing Sheets

IMAGE FORMING APPARATUS, IMAGE FORMING METHOD, AND COMPUTER PROGRAM PRODUCT

CROSS-REFERENCE TO RELATED APPLICATIONS

The present application claims priority to and incorporates by reference the entire contents of Japanese priority document 2008-077170 filed in Japan on Mar. 25, 2008.

BACKGROUND OF THE INVENTION

1. Field of the Invention

The present invention relates to a technology for forming an image in an image forming apparatus.

2. Description of the Related Art

An image forming apparatus, such as a laser printer, employing an electrophotographic system has a problem that an image forming condition such as an image density and an image gradation changes due to change in environment such as temperature and humidity at an area where the image forming apparatus is installed or changes with time. In a conventional image forming apparatus, a patch pattern including a plurality of patches is formed at predetermined timing for providing information necessary for adjusting the image forming condition. A sensor detects the patch pattern and the image forming condition is adjusted based on a result of the detection. However, if the image forming condition is adjusted during a print operation, the print operation needs to be interrupted from the time when formation of the patch pattern is started to the time when detection of the patch pattern ends, which causes downtime of the image forming apparatus thereby reducing productivity of the image forming apparatus.

To solve such a problem, Japanese Patent Application Laid-open No. 2007-133356 discloses an image forming apparatus in which a specific area for forming a patch pattern (hereinafter, patch-pattern forming area) is arranged on an intermediate transfer belt in advance. The intermediate transfer belt is not in contact with a secondary-transfer unit at the patch-pattern forming area and a patch pattern formed at the patch-pattern forming area is detected. With this method, it is possible to reduce time required for detecting the patch pattern.

However, in the above method, because the patch pattern is formed on the intermediate transfer belt such that the patch pattern is arranged in parallel to an image to be transferred onto a recording medium, the size of the image forming apparatus is increased.

SUMMARY OF THE INVENTION

It is an object of the present invention to at least partially solve the problems in the conventional technology.

According to one aspect of the present invention, there is provided an image forming apparatus including a receiving unit that receives a print job from an upper-level apparatus; an image forming unit that forms an image based on the print job; a patch-pattern forming unit that causes the image forming unit to form a patch pattern including a plurality of patches on a conveying member; a detecting unit that detects the patch pattern formed on the conveying member; and an adjusting unit that adjusts an image forming condition of the image forming unit based on a result of a detection by the detecting unit. The patch pattern has a length substantially equal to a distance between a patch-pattern start position, which is located at a space corresponding to at least a predetermined margin of a recording medium from a position of the image, and a position of the detecting unit.

Furthermore, according to another aspect of the present invention, there is provided a computer program product comprising a computer-usable medium having computer-readable program codes embodied in the medium for forming an image in an image forming apparatus that includes a receiving unit, an image forming unit, a patch-pattern forming unit, a detecting unit, and an adjusting unit. The program codes when executed cause a computer to execute receiving including the receiving unit receiving a print job from an upper-level apparatus; image forming including the image forming unit forming an image based on the print job; patch-pattern forming including the patch-pattern forming unit causing the image forming unit to form a patch pattern including a plurality of patches on a conveying member; detecting including the detecting unit detecting the patch pattern formed on the conveying member; and adjusting including the adjusting unit adjusting an image forming condition of the image forming unit based on a result of a detection by the detecting unit. The patch pattern has a length substantially equal to a distance between a patch-pattern start position, which is located at a space corresponding to at least a predetermined margin of a recording medium from a position of the image, and a position of the detecting unit.

Moreover, according to still another aspect of the present invention, there is provided a method for forming an image in an image forming apparatus that includes a receiving unit, an image forming unit, a patch-pattern forming unit, a detecting unit, and an adjusting unit. The method includes receiving including the receiving unit receiving a print job from an upper-level apparatus; image forming including the image forming unit forming an image based on the print job; patch-pattern forming including the patch-pattern forming unit causing the image forming unit to form a patch pattern including a plurality of patches on a conveying member; detecting including the detecting unit detecting the patch pattern formed on the conveying member; and adjusting including the adjusting unit adjusting an image forming condition of the image forming unit based on a result of a detection by the detecting unit. The patch pattern has a length substantially equal to a distance between a patch-pattern start position, which is located at a space corresponding to at least a predetermined margin of a recording medium from a position of the image, and a position of the detecting unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Although image forming apparatuses according to the embodiments are applied to printers, the present invention can be applied to a copier, a scanner, a facsimile machine, or a multifunction product (MFP).

Figure 1:
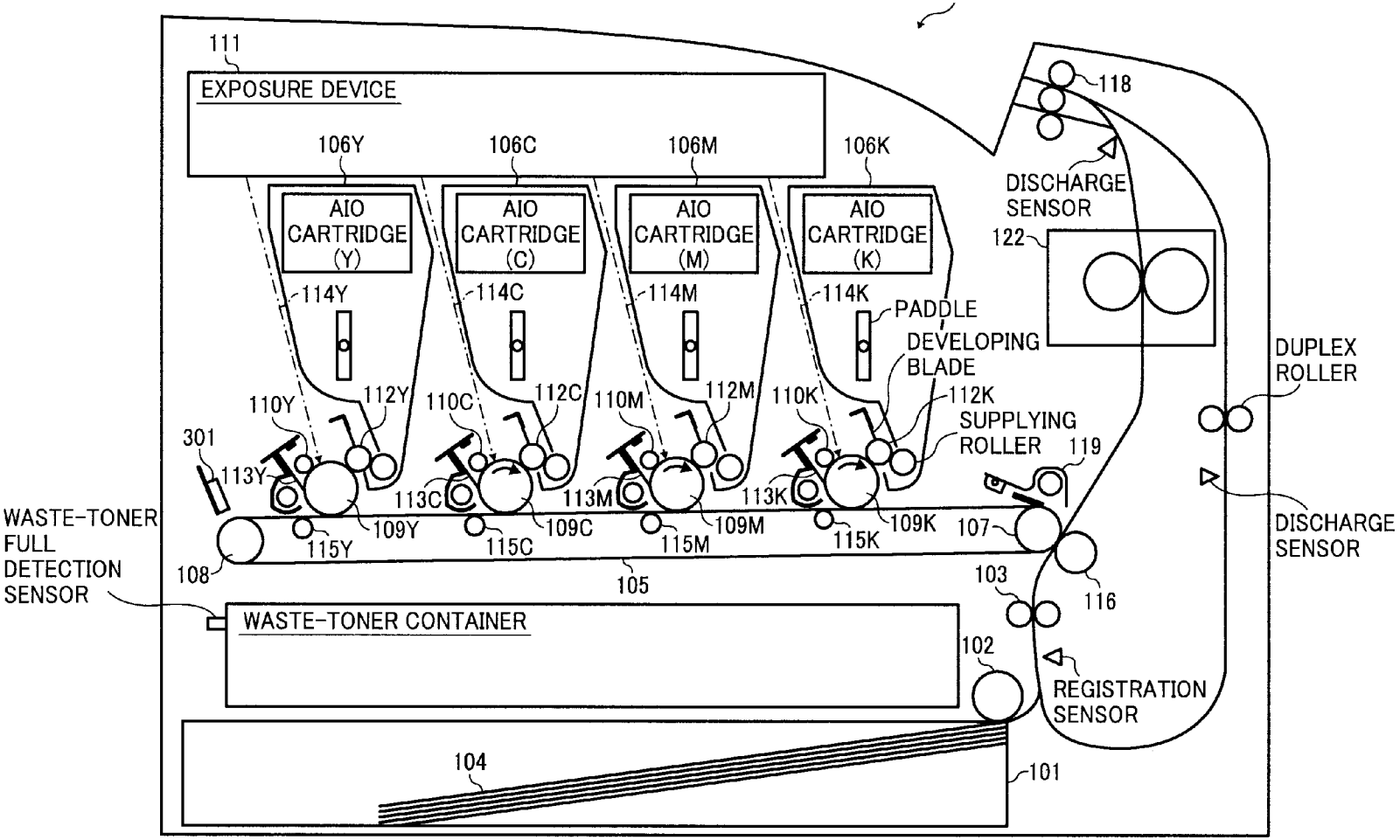
FIG. 1 is a schematic diagram for explaining a configuration of a printer according to a first embodiment of the present invention.

FIG. 1 is a schematic diagram for explaining a configuration of a printer 100 according to a first embodiment of the present invention. The printer 100 includes All-in-One (AIO) cartridges 106K, 106M, 106C, and 106Y (electrophotographic process units) corresponding to four colors of black, magenta, cyan, and yellow that are arranged along an intermediate transfer belt 105. The printer 100 is so-called a tandem-type printer. The intermediate transfer belt 105 is rotated counterclockwise in FIG. 1, and the AIO cartridges 106K, 106M, 106C, and 106Y are sequentially arranged from the upstream side in the rotation direction of the intermediate transfer belt 105. The AIO cartridges 106K, 106M, 106C, and 106Y have the same internal configuration, and are different from one another only in that they form images corresponding to different colors. In other words, the AIO cartridge 106K forms a black image, the AIO cartridge 106M forms a magenta image, the AIO cartridge 106C forms a cyan image, and the AIO cartridge 106Y forms a yellow image.

In the following description, the function and the configuration of the AIO cartridge 106K will be described in detail. Because the function and the configuration of the AIO cartridges 106M, 106C, and 106Y are the same as those of the AIO cartridge 106K, components of each of the AIO cartridges 106M, 106C, and 106Y are shown in the drawings with the same reference numerals but with a corresponding reference mark "M", "C", or "Y" instead of the reference mark "K", and detailed explanation about the components is omitted in the following description.

The intermediate transfer belt 105 is an endless belt supported by a secondary-transfer drive roller 107 and a transfer-belt supporting roller 108. The secondary-transfer drive roller 107 is rotated by a drive motor (not shown). The drive motor, the secondary-transfer drive roller 107, and the transfer-belt supporting roller 108 function as a drive unit that moves the intermediate transfer belt 105.

The AIO cartridge 106K includes a photosensitive element 109K serving as an image carrier, a charging device 110K, a developing device 112K, and a cleaning blade 113K. The charging device 110K, the developing device 112K, and the cleaning blade 113K are arranged around the photosensitive element 109K. An exposure device 111 included in the printer 100 emits laser lights 114K, 114M, 114C, and 114Y that correspond to the black image, the magenta image, the cyan image, and the yellow image formed by the AIO cartridges 106K, 106M, 106C, and 106Y, respectively.

When an image is to be formed, the outer surface of the photosensitive element 109K is uniformly charged by the charging device 110K in the dark and is then irradiated with the laser light 114K whereby an electrostatic latent image is formed on the outer surface of the photosensitive element 109K. The developing device 112K applies black toner to the electrostatic latent image thereby developing the image. Thus, a black toner image is formed on the outer surface of the photosensitive element 109K.

The black toner image is then transferred onto the intermediate transfer belt 105 by a primary-transfer roller 115K arranged along the intermediate transfer belt 105 at a primary-transfer position where the photosensitive element 109K is in contact with the intermediate transfer belt 105. Thus, the black toner image is formed on the intermediate transfer belt 105. After the black toner image is transferred onto the intermediate transfer belt 105, the cleaning blade 113K removes residual toner from the outer surface of the photosensitive element 109K. The photosensitive element 109K then stands by for the next image forming process.

The intermediate transfer belt 105 is then moved to the AIO cartridge 106M. The AIO cartridge 106M performs the same image forming process as that performed by the AIO cartridge 106K whereby a magenta toner image is formed on the outer surface of a photosensitive element 109M. The magenta toner image is then transferred onto the intermediate transfer belt 105 where the black toner image has been transferred in a superimposed manner.

The intermediate transfer belt 105 is moved to the AIO cartridge 106C and then to the AIO cartridge 106Y. The AIO cartridges 106M and 106Y perform the same image forming process, so that a cyan toner image is formed on a photosensitive element 109C and a yellow toner image is formed on a photosensitive element 19Y. The cyan toner image and the yellow toner image are then transferred onto the intermediate transfer belt 105 in a superimposed manner. In this manner, a full-color image is formed on the intermediate transfer belt 105.

If only a black image is to be formed, primary-transfer rollers 115M, 115C, and 115Y are arranged at a position from the photosensitive elements 109M, 109C, and 109Y, respectively, so that only the AIO cartridge 106K performs the image forming process.

A feed unit including a feed tray 101, a feed roller 102, and a pair of registration rollers 103 is arranged under the intermediate transfer belt 105. A secondary-transfer roller 116 is arranged parallel to the secondary-transfer drive roller 107. A secondary transfer nip is formed between the secondary-transfer drive roller 107 and the secondary-transfer roller 116 that sandwich the intermediate transfer belt 105 between them. A fixing device 122 and a pair of discharging rollers 118 are arranged above the secondary transfer nip.

The feed tray 101 contains a pile of sheets (hereinafter, "recording media") 104. The recording medium 104 on the top of the pile is in contact with the feed roller 102. The feed roller 102 is rotated by a drive unit (not shown), so that the recording medium 104 is fed from the feed tray 101 and is temporarily stopped such that an edge of the recording medium 104 is in contact with the registration rollers 103. The feed roller 102 then conveys the recording medium 104 toward the secondary transfer nip to which transfer bias is applied at appropriate timing. The full-color image formed on the intermediate transfer belt 105 is transferred onto the recording medium 104 at the secondary transfer nip. After the intermediate transfer belt 105 passes through the secondary transfer nip, residual toner remains on the intermediate transfer belt 105. The residual toner is removed by an intermediate belt cleaner 119 that is arranged downstream of the secondary transfer nip in a direction in which the image formed on the intermediate transfer belt 105 is conveyed.

After the recording medium 104 passes through the secondary transfer nip, the recording medium 104 is conveyed between a pair of rollers included in the fixing device 122 whereby the image transferred onto the surface of the recording medium 104 is fixed with heat and pressure applied from the rollers. Afterward, the recording medium 104 is discharged out of the printer 100 by the discharging rollers 118.

Figure 2:
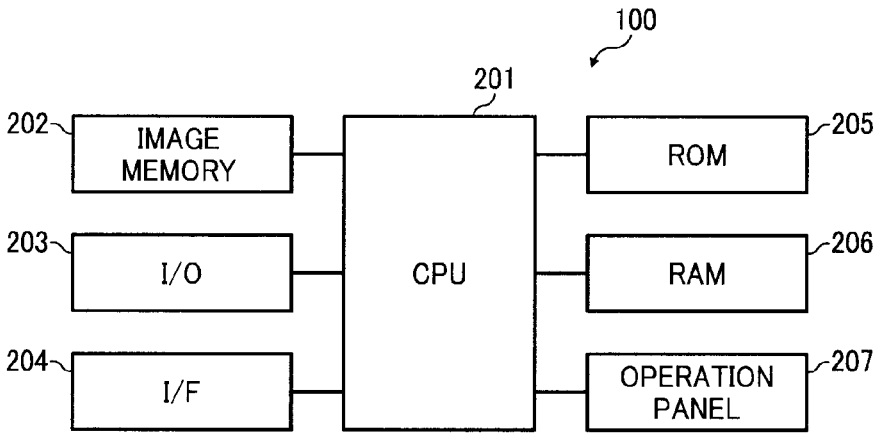
FIG. 2 is a block diagram for explaining the basic electrical configuration of the printer according to the first embodiment.

FIG. 2 is a block diagram for explaining the basic electrical configuration of the printer 100. The printer 100 includes a central processing unit (CPU) 201, an image memory 202, an input/output unit (I/O) 203, an interface (I/F) 204, a read-only memory (ROM) 205, a random access memory (RAM) 206, and an operation panel 207. The image memory 202, the I/O 203, the I/F 204, the ROM 205, the RAM 206, and the operation panel 207 are connected to the CPU 201.

The ROM 205 stores therein a computer program for controlling the printer 100. The RAM 206 temporarily stores therein various information about the printer 100.

The I/F 204 receives a print job or a reply to a user's inquiry from a personal computer (PC) or a server computer connected to the printer 100 via a cable, or the like. The I/O 203 controls input and output of the AIO cartridges 106K, 106M, 106C, and 106Y and an electric component such as a sensor. The image memory 202 temporarily stores therein image data. The operation panel 207 is used for a user to understand a state of the printer 100 and specify settings to change an operation of the printer 100.

Because the image memory 202 and the RAM 206 can store therein various data in a rewritable manner, each of the image memory 202 and the RAM 206 functions as a work area of the CPU 201 and serves as a buffer or the like.

The ROM 205 as a storage medium according to the present embodiment stores therein an operating system (OS) and various computer programs. The CPU 201 executes a computer program stored in the ROM 205 thereby controlling an operation performed by the printer 100.

The storage medium can be various types of media such as various optical disks (e.g., a digital versatile disk (DVD)), various magnetooptic disks, various magnetic disks (e.g., a flexible disk), and a semiconductor memory. A computer program can be downloaded from a network such as the Internet via the I/F 204 and installed in a main storage device such as a hard disk drive (HDD). In this case, a storage device included in a server computer from which the computer program is transmitted is also the storage medium according to the present embodiment. A computer program can be executed on a predetermined OS, and in such a case, a part of various operations described later can be performed by the OS, or the computer program can be included as a part of a group of computer program files constituting predetermined application software or OS.

The CPU 201 that controls an operation of the whole system performs various operations based on a computer program stored in the ROM 205.

Because the image forming apparatus employing the electrophotographic system has a problem that image density and image gradation change due to change in an environment such as temperature and humidity or change with passage of time, it is necessary to adjust an image forming condition in response to image variation at predetermined timing, for example, when turning on a main power source of the image forming apparatus, when the image forming apparatus is in a standby state after a predetermined time elapses, or after a print operation is performed on more than a predetermined number of recording media. In the printer 100, a patch pattern including a plurality of patches is formed and the patch pattern is detected by a reflection-type photosensor 301 included in the printer 100, so that image forming conditions of the AIO cartridges 106K, 106M, 106C, and 106Y are adjusted based on a result of the detection of the patch pattern. First, the outer surfaces of the AIO cartridges 106K, 106M, 106C, and 106Y are uniformly charged while the AIO cartridges 106K, 106M, 106C, and 106Y are rotated. Then, the outer surfaces of the AIO cartridges 106K, 106M, 106C, and 106Y are irradiated with the laser lights 114K, 114M, 114C, and 114Y while power of the laser lights 114K, 114M, 114C, and 114Y is gradually increased, so that electrostatic latent images for a patch pattern are formed on the outer surfaces of the AIO cartridges 106K, 106M, 106C, and 106Y. The electrostatic latent images are developed by the developing devices 112K, 112C, 112M, and 112Y, and the developed images are transferred onto the intermediate transfer belt 105 whereby the patch pattern is formed on the intermediate transfer belt 105.

Figure 3:
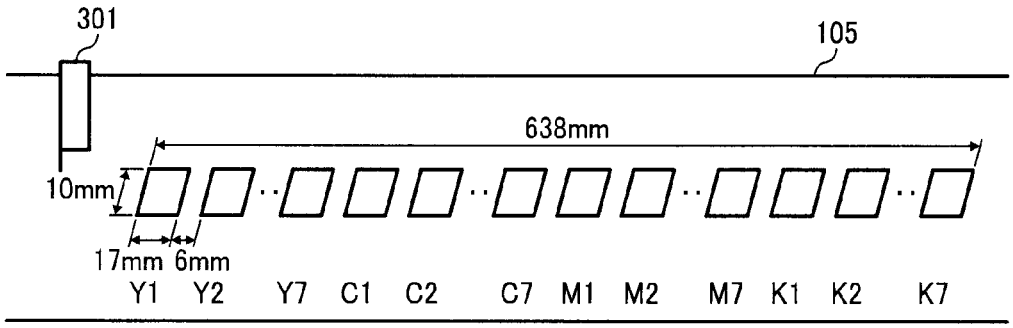
FIG. 3 is a schematic diagram for explaining an example of a patch pattern formed on an intermediate transfer belt shown in FIG. 1.

FIG. 3 is a schematic diagram for explaining an example of the patch pattern formed on the intermediate transfer belt 105. In the patch pattern, seven patches each having different density are formed for each of the four colors. The patch has substantially rectangular with 10 millimeters (mm) on one side and 17 (mm) on the other side. The patches are formed at an interval of 6 mm. If the seven patches each having different density are formed for each of the four colors, the patch pattern having the entire length of 638 mm is formed on the intermediate transfer belt 105.

The photosensor 301 is arranged downstream of the AIO cartridges 106K, 106M, 106C, and 106Y in the direction in which an image formed on the intermediate transfer belt 105 is conveyed, and detects the patch pattern formed by the AIO cartridges 106K, 106M, 106C, and 106Y. When the patch pattern passes through an opposing position where the intermediate transfer belt 105 is opposed to the photosensor 301 in accordance with the movement of the intermediate transfer belt 105, the photosensor 301 detects reflected light intensity from the patch pattern. Then, the image forming conditions of the AIO cartridges 106K, 106M, 106C, and 106Y are adjusted based on a result of the detection the patch pattern.

The detected light intensity is converted into an amount of toner on the intermediate transfer belt 105, and the amount of toner is stored as density pattern data for each of the colors. An approximation of a laser power and the amount of toner is calculated from the density pattern data. Then, the laser power by which desired amount of toner can be obtained is determined based on the approximation, and the determined laser power is set as a corrected image forming condition. A patch that has passed through the opposing position is removed by the intermediate belt cleaner 119.

Figure 4:
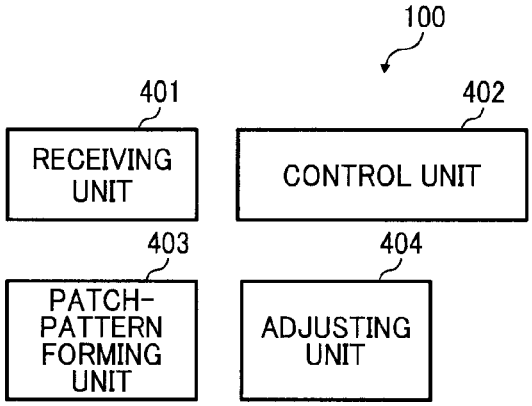
FIG. 4 is a block diagram for explaining the functional configuration of the printer according to the first embodiment.
Figure 5:
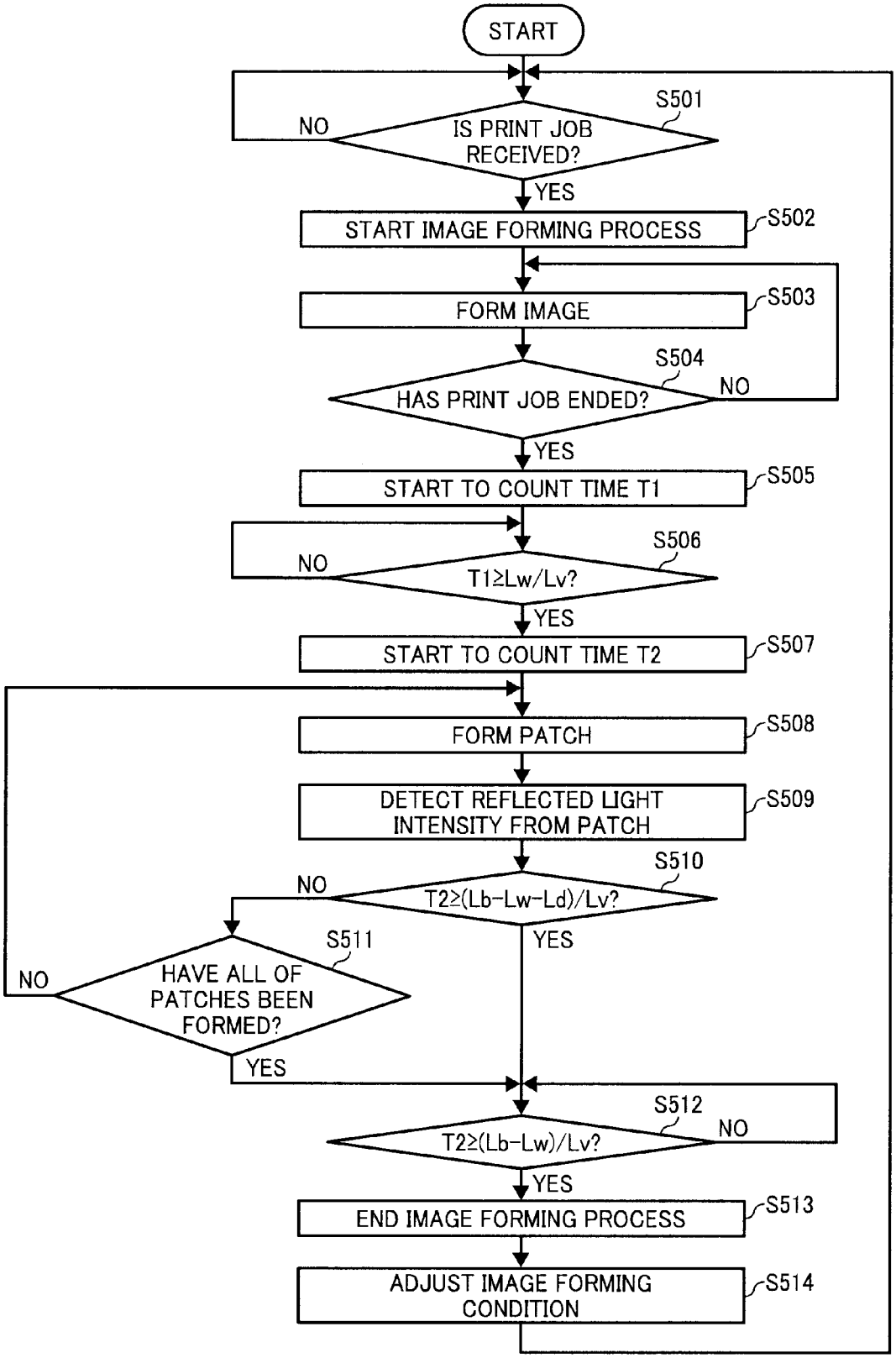
FIG. 5 is a flowchart of an operation of adjusting an image forming condition performed by the printer according to the first embodiment.

FIG. 4 is a block diagram for explaining the functional configuration of the printer 100. FIG. 5 is a flowchart of an operation of adjusting the image forming condition performed by the printer 100. As shown in FIG. 4, the printer 100 implements a receiving unit 401, a control unit 402, a patch-pattern forming unit 403, and an adjusting unit 404 based on an image forming program.

The receiving unit 401 receives a print job via the I/F 204 (Yes at Step S501), and loads a print data included in the print job into the RAM 206. Furthermore, the receiving unit 401 converts the print data loaded into the RAM 206 into image data, and loads the image data into the image memory 202. If the receiving unit 401 does not receive a print job via the I/F 204 (No at Step S501), the receiving unit 401 stands by until a print job is received.

The control unit 402 causes the AIO cartridges 106K, 106M, 106C, and 106Y to form images on the intermediate transfer belt 105 based on the print job.

Specifically, when the receiving unit 401 receives the print job (Yes at Step S501), the control unit 402 drives the photosensitive elements 109K, 109M, 109C, and 109Y and the intermediate transfer belt 105, and applies bias to the charging devices 110K, 110M, 110C, and 110Y, the developing devices 112K, 112M, 112C, and 112Y, and the primary-transfer rollers 115K, 115M, 115C, and 115Y, so that an image forming process is started (Step S502). The control unit 402 then causes the exposure device 111 to emit the laser lights 114K, 114M, 114C, and 114Y based on the image data loaded into the image memory 202 whereby images are formed on the intermediate transfer belt 105 based on the print job (Step S503).

The control unit 402 determines whether all images have been formed on the intermediate transfer belt 105 based on the print job. Thus, the control unit 402 determines whether the entire print job has ended (Step S504). Specifically, it is determined whether images corresponding to the entire image data loaded into the image memory 202 have been formed.

If it is determined that the entire print job has not ended (No at Step S504), the control unit 402 causes an unformed image to be formed (Step S503).

If it is determined that the entire print job has ended (Yes at Step S504), the patch-pattern forming unit 403 causes the AIO cartridges 106K, 106M, 106C, and 106Y to form a patch pattern having a length substantially equal to a distance between a start position of the patch pattern and a position of the photosensor 301. The start position is located a space corresponding to at least a predetermined margin of the recording medium 104 from a position of the images formed by the AIO cartridges 106K, 106M, 106C, and 106Y based on the print job.

Specifically, the patch-pattern forming unit 403 starts to count an elapsed time T1 based on a real time clock (RTC) (not shown) when all images have been formed based on the print job (when a final image formed based on the print job is transferred onto the intermediate transfer belt 105) (Step S505). The patch-pattern forming unit 403 then determines whether an inequality $T1 \geqq Lw/Lv$ is satisfied where Lw is a distance corresponding to a margin on a lower end of the recording medium 104 on which the final image formed based on the print job is to be transferred and Lv is a linear velocity of the intermediate transfer belt 105 (Step S506). Specifically, the patch-pattern forming unit 403 determines whether the inequality $T1 \geqq Lw/Lv$ is satisfied thereby determining whether a non-image area having a space corresponding to the margin of the recording medium 104 is obtained on the intermediate transfer belt 105 after the final image formed based on the print job. If it is determined that the inequality $T1 \geqq Lw/Lv$ is not satisfied (No at Step S506), the patch-pattern forming unit 403 repeats determination until a non-image area having a space corresponding to the margin of the recording medium 104 is obtained on the intermediate transfer belt 105.

If it is determined that the inequality $T1 \geqq Lw/Lv$ is satisfied (Yes at Step S506), the patch-pattern forming unit 403 starts to count an elapsed time T2 by using the RTC (Step S507). The patch-pattern forming unit 403 then causes a patch to be formed on the intermediate transfer belt 105 (Step S508). Each time the patch is formed on the intermediate transfer belt 105, the photosensor 301 detects reflected light intensity from the patch pattern (Step S509), and stores a result of the detection in the RAM 206. Furthermore, each time the photosensor 301 detects the reflected light intensity from the patch, the patch-pattern forming unit 403 substitutes a sequential identification number (1: Y1, 2: Y2, . . . , 28: K7) that is assigned to each of the patches for the four colors for a variable number i stored in a register (not shown).

Figure 6:
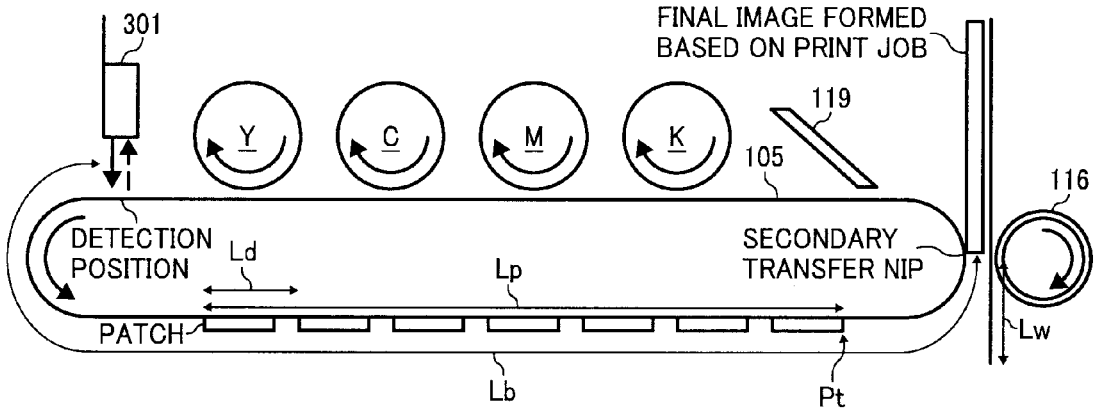
FIG. 6 is a schematic diagram for explaining an example of the patch pattern formed on the intermediate transfer belt.

The patch-pattern forming unit 403 then determines whether an inequality $T2 \geqq (Lb-Lw-Ld)/Lv$ is satisfied (Step S510). FIG. 6 is a schematic diagram for explaining an example of the patch pattern formed on the intermediate transfer belt 105. Lb is a distance between the position of the photosensor 301 and the position of the secondary transfer nip where the final image formed based on the print job is transferred onto the recording medium 104 by the secondary-transfer roller 116. Ld is obtained by summing a length (17 mm) of a patch in a direction in which the intermediate transfer belt 105 is conveyed and an interval (6 mm) between patches. Lp is the entire length of the patch pattern in the direction in which the intermediate transfer belt 105 is conveyed. Pt is a start position of the patch pattern to be formed on the intermediate transfer belt 105. The patch-pattern forming unit 403 determines whether the inequality $T2 \geqq (Lb-Lw-Ld)/Lv$ is satisfied thereby determining whether there is still time to form a subsequent patch on the intermediate transfer belt 105.

If the inequality $T2 \geqq (Lb-Lw-Ld)/Lv$ is not satisfied (No at Step S510), the patch-pattern forming unit 403 determines that if a subsequent patch is formed on the intermediate transfer belt 105, the photosensor 301 can detect reflected light intensity from the patch pattern before the final image formed based on the print job reaches the secondary transfer nip. The patch-pattern forming unit 403 then determines whether all of the patches included in the patch pattern have been formed on the intermediate transfer belt 105 (Step S511). Specifically, it is determined whether all of the patches have been formed on the intermediate transfer belt 105 based on whether the identification number substituted for the variable number i stored in the register is equal to the total number of the patches ("28" in the first embodiment).

If it is determined that not all of the patches have been formed on the intermediate transfer belt 105 (No at Step S511), the process control returns to Step S508. On the other hand, if it is determined that all of the patches have been formed on the intermediate transfer belt 105 (Yes at Step S511), or if it is determined that the inequality T2≧(Lb−Lw−Ld)/Lv is satisfied and the photosensor 301 cannot detect reflected light intensity from the patch pattern before the image formed based on the print job reaches the secondary transfer nip if a subsequent patch is formed on the intermediate transfer belt 105 (Yes at Step S510), the patch-pattern forming unit 403 determines whether an inequality T2≧(Lb−Lw)/Lv is satisfied (Step S512). Thus, the patch-pattern forming unit 403 determines whether detection of the light intensity has ended for all of the patches formed on the intermediate transfer belt 105. If the inequality T2≧(Lb−Lw)/Lv is not satisfied (No at Step S512), the patch-pattern forming unit 403 repeats determination until the inequality T2≧(Lb−Lw)/Lv is satisfied. In this manner, the patch-pattern forming unit 403 can cause the patch pattern having the length Lp shorter than or substantially equal to a distance between the position indicated by Pt and the position of the photosensor 301 to be formed on the intermediate transfer belt 105.

If the inequality T2≧(Lb−Lw)/Lv is satisfied (Yes at Step S512), the control unit 402 determines that the final image formed based on the print job reaches the secondary transfer nip (or determines that the detection of the light intensity has ended for all of the patches), and stops applying the bias to the charging devices 110K, 110M, 110C, and 110Y, the developing devices 112K, 112M, 112C, and 112Y, and the primary-transfer rollers 115K, 115M, 115C, and 115Y, so that the image forming process ends (Step S513).

The adjusting unit 404 determines an optimum laser power based on the reflected light intensity from each of the patches stored in the RAM 206 thereby adjusting the image forming condition (Step S514). After the image forming condition is adjusted, the process control returns to Step S501.

As described above, the AIO cartridges 106K, 106M, 106C, and 106Y form the patch pattern having a length substantially equal to a distance between the start position of the patch pattern and the position of the photosensor 301. The start position is located a space corresponding to at least a predetermined margin of the recording medium 104 from a position of the final image formed on the intermediate transfer belt 105 by the AIO cartridges 106K, 106M, 106C, and 106Y based on the print job. Therefore, it is possible to detect density of the patch pattern before the final image reaches the secondary transfer nip, so that downtime caused by the adjustment of the image forming condition can be reduced while productivity of the image forming apparatus is maintained.

Because the function and the configuration of the printer 100 according to a second embodiment of the present invention is substantially the same as those of the printer 100 according to the first embodiment, only a different part is explained. In the printer 100 according to the second embodiment, if a new print job is received when the patch pattern is formed, the operation of forming the patch pattern is stopped, so that the downtime caused due to the adjustment of the image forming condition can be reduced.

Figure 7:
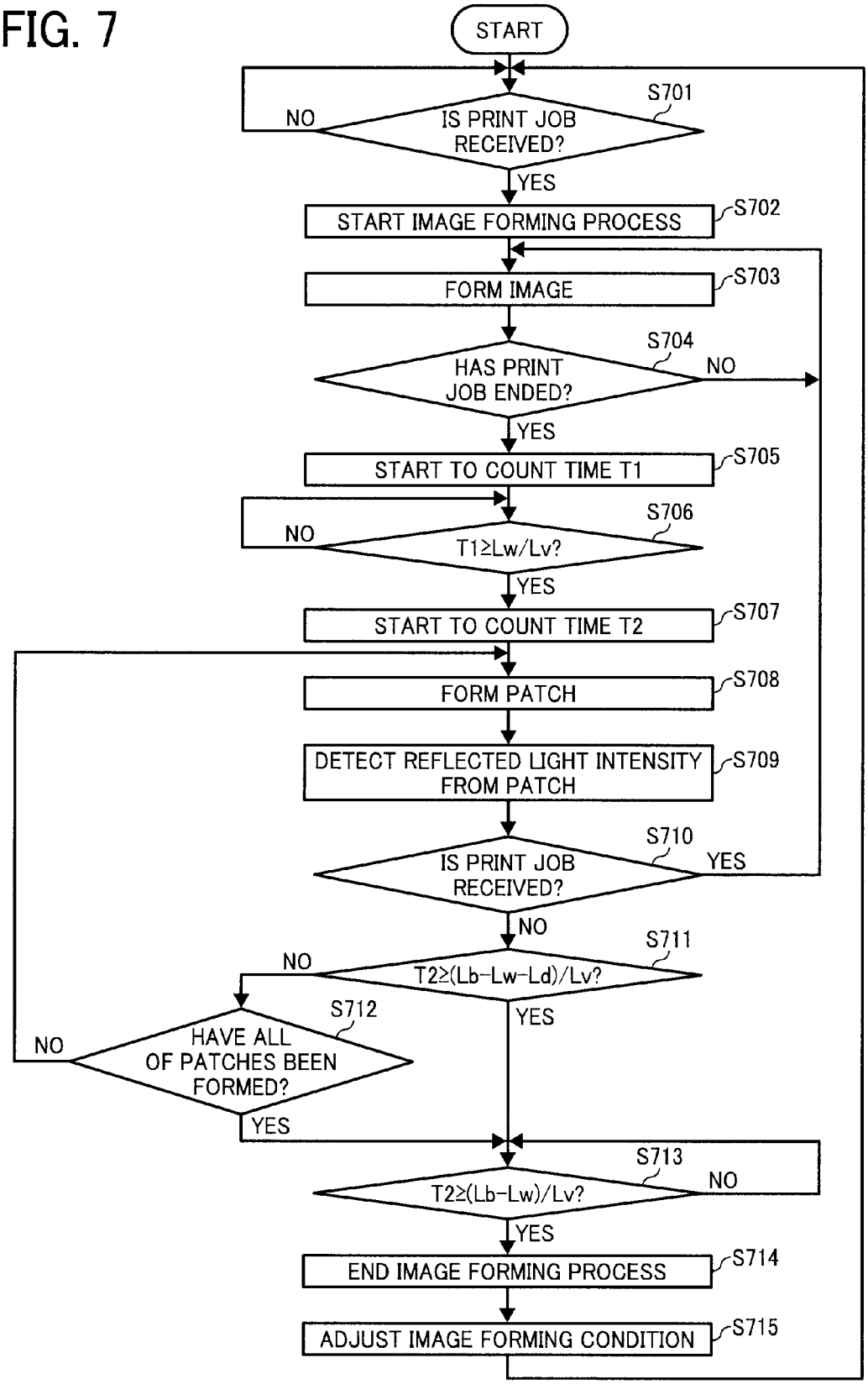
FIG. 7 is a flowchart of an operation of adjusting the image forming condition performed by the printer according to a second embodiment of the present invention.

FIG. 7 is a flowchart of an operation of adjusting the image forming condition performed by the printer 100 according to the second embodiment. Because the operation shown in FIG. 7 is substantially the same as that shown in FIG. 5, only a different part is explained. The explanation about operations performed at Steps S701 to S709 and S711 to S715 is omitted.

If the receiving unit 401 receives a new print job when the AIO cartridges 106K, 106M, 106C, and 106Y form the patch pattern on the intermediate transfer belt 105, the patch-pattern forming unit 403 stops the operation of forming the patch pattern. Specifically, after the reflected light intensity from the patch is detected at Step S709, it is determined whether the receiving unit 401 receives a new print job (Step S710). If the receiving unit 401 receives a new print job (Yes at Step S710), the patch-pattern forming unit 403 stops the operation of forming the patch pattern, and the process control returns to Step S703 without adjusting the image forming condition.

On the other hand, if the receiving unit 401 does not receive a new print job (No at Step S710), the patch-pattern forming unit 403 determines whether the inequality T2≧(Lb−Lw)/Lv is satisfied (Step S711), and then the operation of forming a patch and the operation of detecting reflected light intensity from the patch pattern are performed.

As described above, if a new print job is received when the patch pattern is formed on the intermediate transfer belt 105, the operation of forming the patch pattern is stopped, so that the downtime caused by the adjustment of the image forming condition can be reduced.

Because the function and the configuration of a printer according to a third embodiment of the present invention is substantially the same as those of the printer 100 according to the second embodiment, only a different part is explained. In the printer according to the third embodiment, when the patch pattern is formed on the intermediate transfer belt 105 by the AIO cartridges 106K, 106M, 106C, and 106Y, an unformed patch is first formed, so that all of the patches can be formed.

Figure 8:
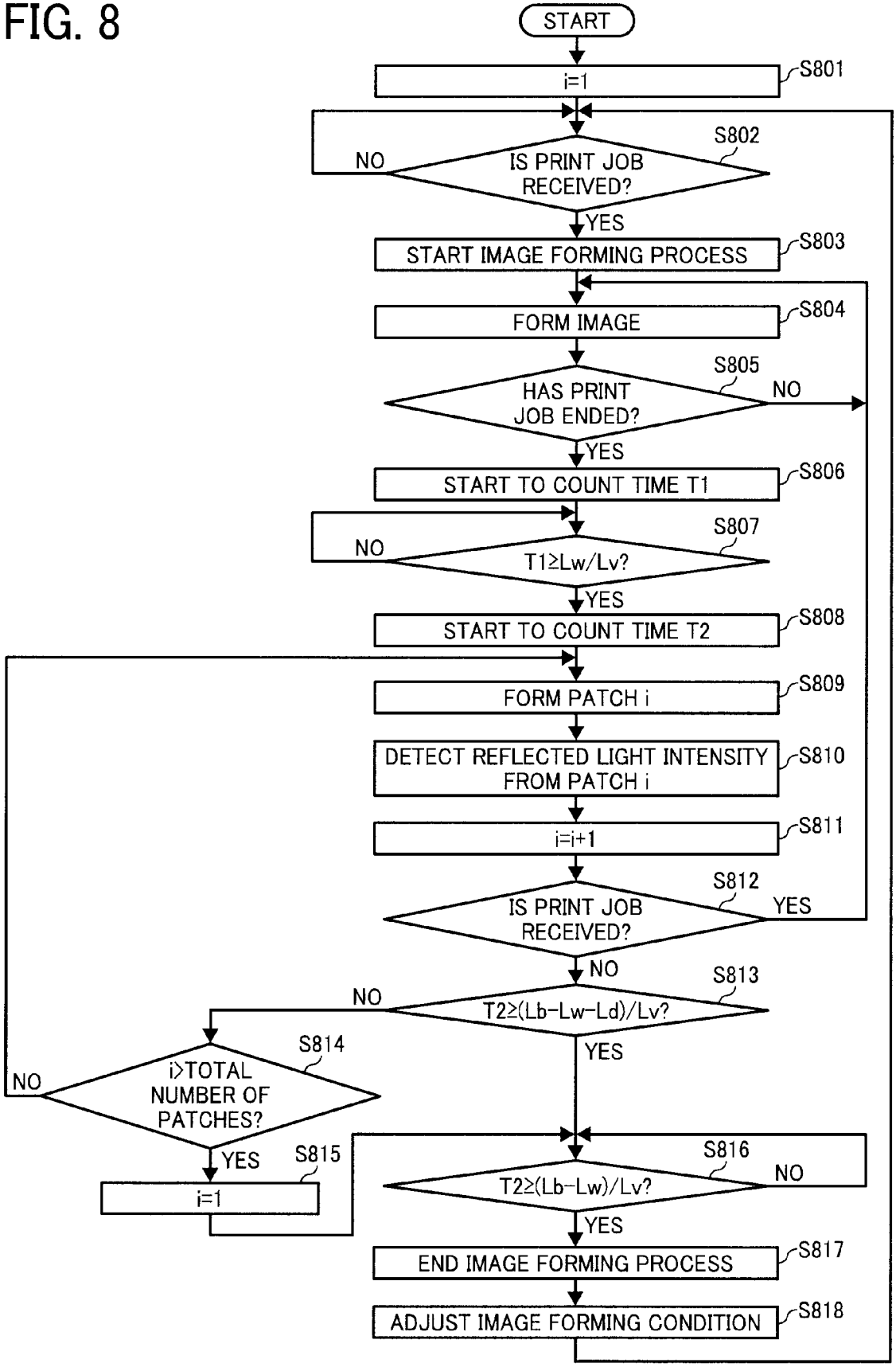
FIG. 8 is a flowchart of an operation of adjusting the image forming condition performed by the printer according to a third embodiment of the present invention.

FIG. 8 is a flowchart of an operation of adjusting the image forming condition performed by the printer according to the third embodiment. Because the operation shown in FIG. 8 is substantially the same as that shown in FIG. 7, only a different part is explained. The explanation about operations performed at Steps S802 to S808, S812 to S813, and S816 to S818 is omitted.

The printer includes a register in which patch information indicating whether each of the patches included in the patch pattern has been formed on the intermediate transfer belt 105 is stored. The patch information is the variable number i indicating a sequential identification number assigned to each of the patches for the four colors, and it indicates that a patch to which an identification number smaller than the variable number i is assigned has been formed.

The patch-pattern forming unit 403 causes the AIO cartridges 106K, 106M, 106C, and 106Y to first form an unformed patch included in the patch pattern on the intermediate transfer belt 105 based on the patch information stored in the register.

Specifically, the patch-pattern forming unit 403 substitutes the value "1" for the variable number i stored in the register when the image forming operation is performed (Step S801). As described above, the variable number i is the sequential identification number (1: Y1, 2: Y2, . . . , 28: K7) that is assigned to each of the patches for the four colors.

After the patch-pattern forming unit 403 starts to count the elapsed time T2 (Step S808), the patch-pattern forming unit 403 causes a patch i corresponding to the identification number substituted for the variable number i stored in the register to be formed on the intermediate transfer belt 105 (Step S809) and reflected light intensity from the patch pattern i to be detected (Step S810). The patch-pattern forming unit 403 then adds the value "1" to the variable number i stored in the register (Step S811), so that the variable number i indicates a subsequent patch.

If a new print job is not received (No at Step S812), and the inequality T2≧(Lb−Lw−Ld)/Lv is not satisfied (No at Step S813), the patch-pattern forming unit 403 determines whether the variable number i stored in the register is larger than the total number of the patches ("28" in the third embodiment) (Step S814). If it is determined that the variable number i is equal to or smaller than the total number of the patches (No at Step S814), the patch-pattern forming unit 403 causes a subsequent patch to be formed. On the other hand, if it is determined that the variable number i is larger than the total number of the patches (Yes at Step S814), the patch-pattern forming unit 403 resets the variable number i stored in the register to the value "1" (Step S815), and determines whether the inequality T2≧(Lb−Lw)/Lv is satisfied (Step S816).

As described above, when the patch pattern is formed on the intermediate transfer belt 105 by the AIO cartridges 106K, 106M, 106C, and 106Y, an unformed patch is first formed on the intermediate transfer belt 105, so that all of the patches can be formed.

Because the function and the configuration of a printer 900 according to a forth embodiment of the present invention is substantially the same as those of the printer according to the third embodiment, only a different part is explained. In the printer 900, when the patch pattern passes the secondary-transfer roller 116, secondary-transfer reverse bias is applied to the secondary-transfer roller 116, so that it is possible to prevent toner from being scattered around the secondary-transfer roller 116 when the patch pattern passes through the secondary transfer nip and prevent the back side of the recording medium 104 from being stained with toner.

Figure 9:
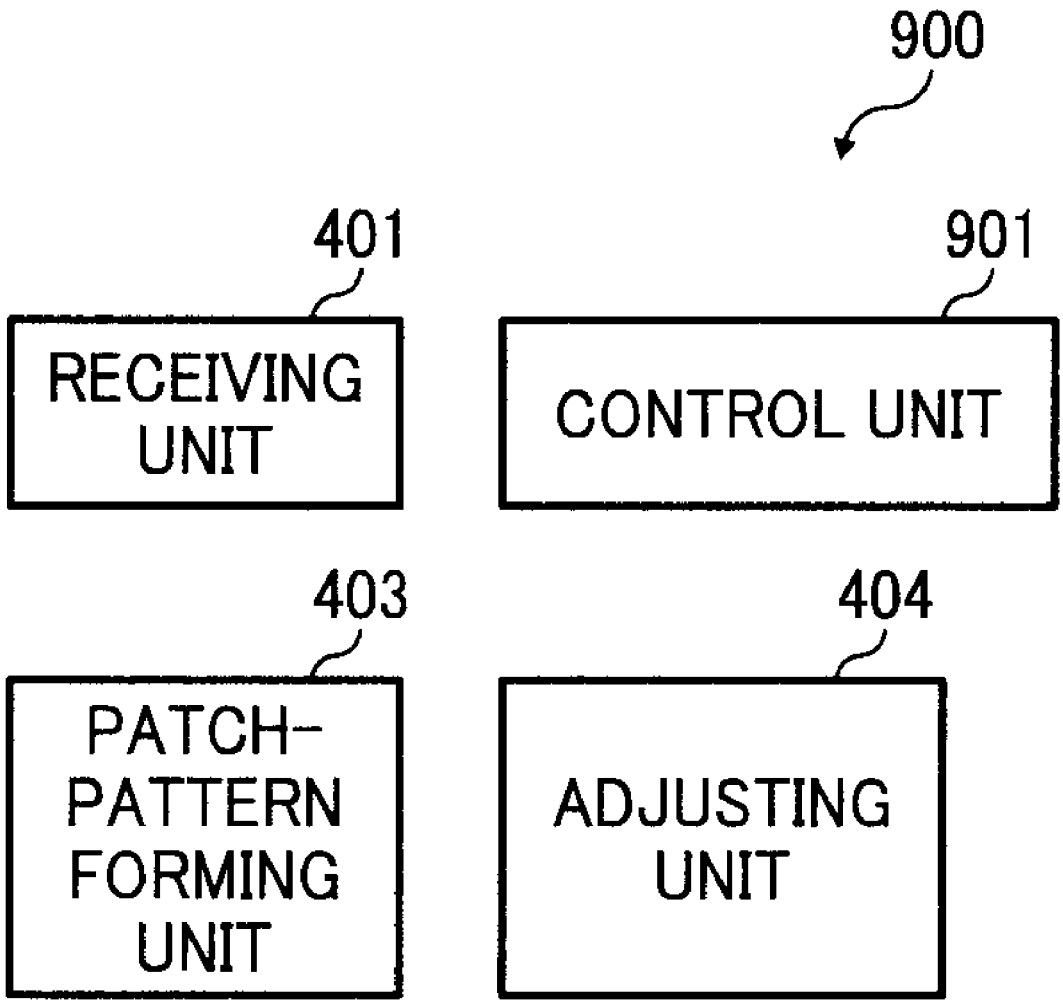
FIG. 9 is a block diagram for explaining a functional configuration of a printer according to a fourth embodiment of the present invention.
Figure 10:
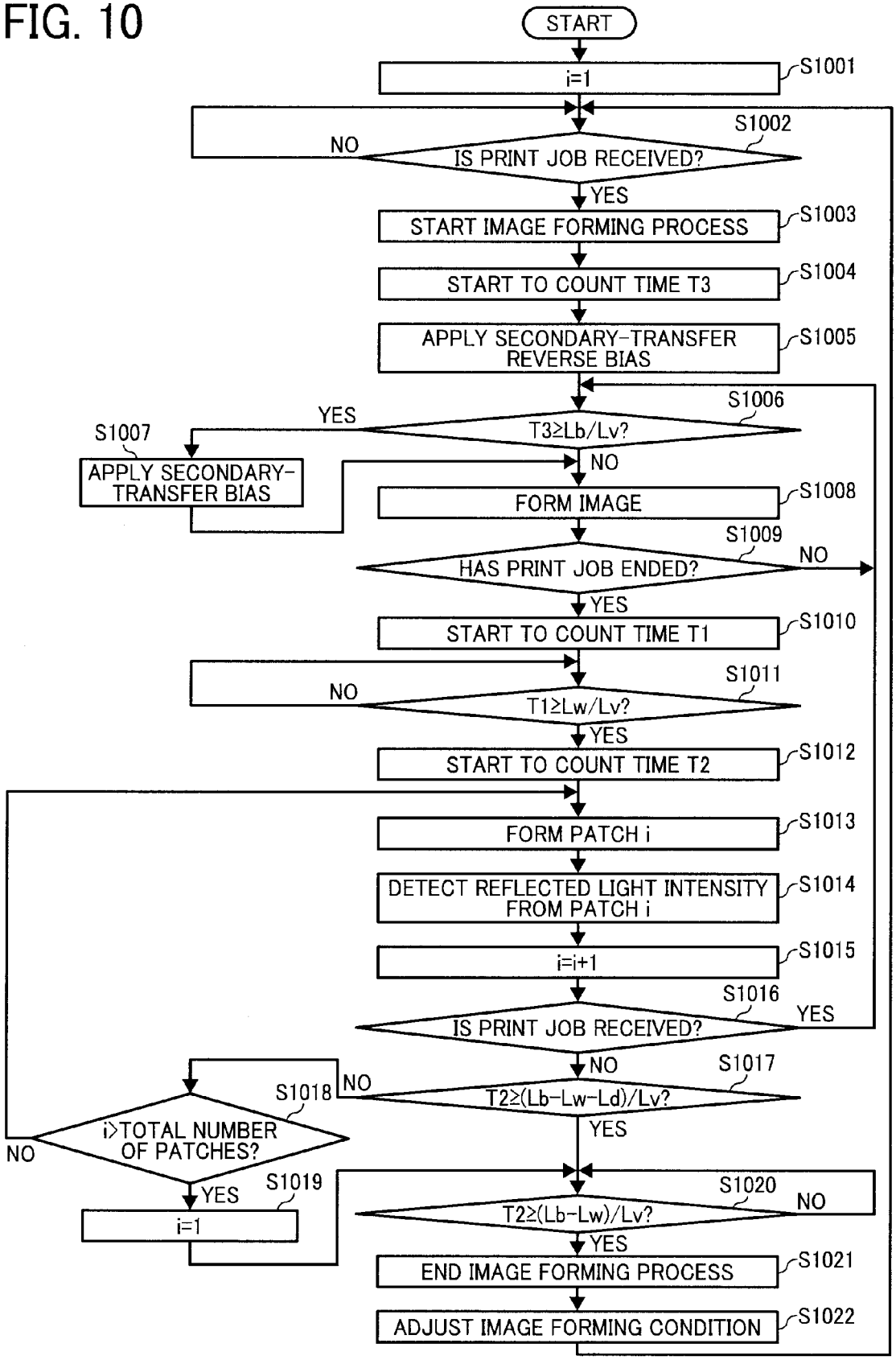
FIG. 10 is a flowchart of an operation of adjusting the image forming condition performed by the printer according to the fourth embodiment.

FIG. 9 is a block diagram for explaining the functional configuration of the printer 900. FIG. 10 is a flowchart of an operation of adjusting the image forming condition performed by the printer 900. The functional configuration of the printer 900 is the same as those described in the above embodiments except that a control unit 901 included in the printer 900 performs a different operation. Because the operation shown in FIG. 10 is substantially the same as that shown in FIG. 8, only a different part is explained. The explanation about operations performed at Steps S1001 to S1003 and S1008 to S1022 is omitted.

When the patch pattern passes the secondary-transfer roller 116, the control unit 901 applies the secondary-transfer reverse bias to the secondary-transfer roller 116. After the patch pattern passes the secondary-transfer roller 116, the control unit 901 causes the intermediate belt cleaner 119 to remove the patch pattern from the intermediate transfer belt 105.

Specifically, when the image forming process is started, the control unit 901 starts to count an elapsed time T3 by using the RTC (Step S1004). The control unit 901 then applies the secondary-transfer reverse bias to the secondary-transfer roller 116 so that toner on the intermediate transfer belt 105 is prevented from being scattered around the secondary-transfer roller 116 (Step S1005). The control unit 901 then determines whether an inequality T3≧Lb/Lv is satisfied (Step S1006). If it is determined that the inequality T3≧Lb/Lv is not satisfied (No at Step S1006), the control unit 901 determines that the patch pattern is passing through the secondary transfer nip, and keeps the image forming operation (Step S1008). On the other hand, if it is determined that the inequality T3≧Lb/Lv is satisfied (Yes at Step S1006), the control unit 901 determines that the patch pattern has passed through the secondary transfer nip and the image formed based on the print job is reaching the secondary transfer nip, and then applies secondary-transfer bias to the secondary-transfer roller 116 (Step S1007) whereby the image is transferred onto the recording medium 104 at the secondary transfer nip.

As described above, when the patch pattern passes the secondary-transfer roller 116, the secondary-transfer reverse bias is applied to the secondary-transfer roller 116, so that it is possible to prevent toner from being scattered around the secondary-transfer roller 116 when the patch pattern passes through the secondary transfer nip and prevent the back side of the recording medium 104 from being stained with toner.

Because the function and the configuration of a printer 1100 according to a fifth embodiment of the present invention is substantially the same as those of the printer 900, only a different part is explained. In the printer 1100, when more than a predetermined time elapses after the patch pattern is formed on the intermediate transfer belt 105, the patch pattern is removed from the intermediate transfer belt 105, so that it is possible to prevent the inside of the printer from getting dirty.

Figure 11:
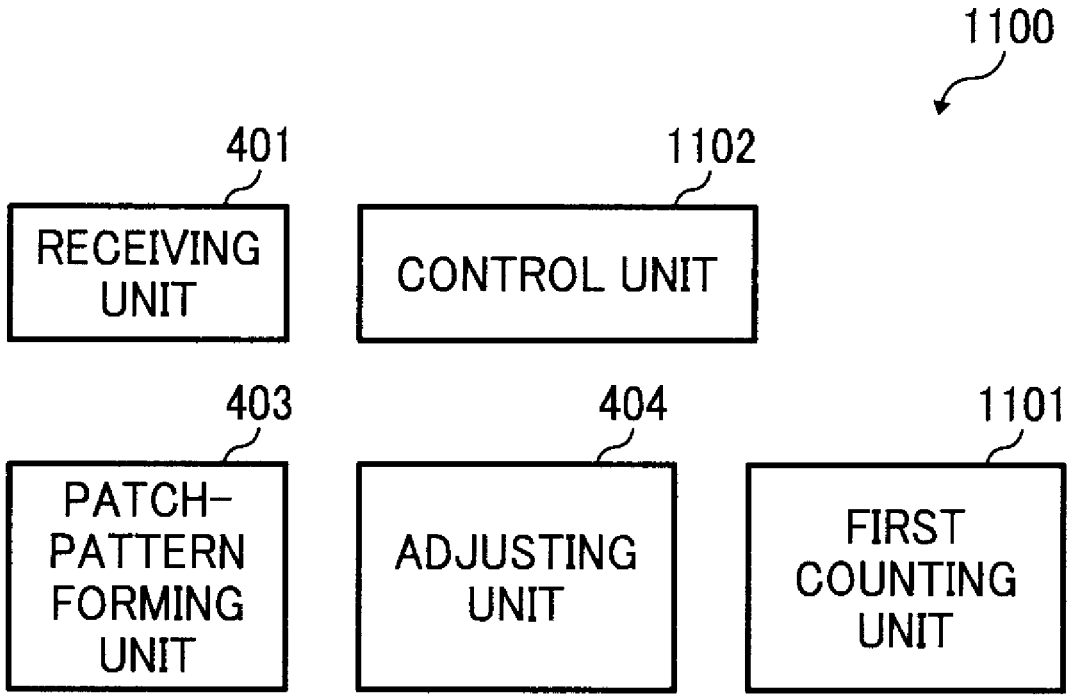
FIG. 11 is a block diagram for explaining a functional configuration of a printer according to a fifth embodiment of the present invention.
Figure 12:
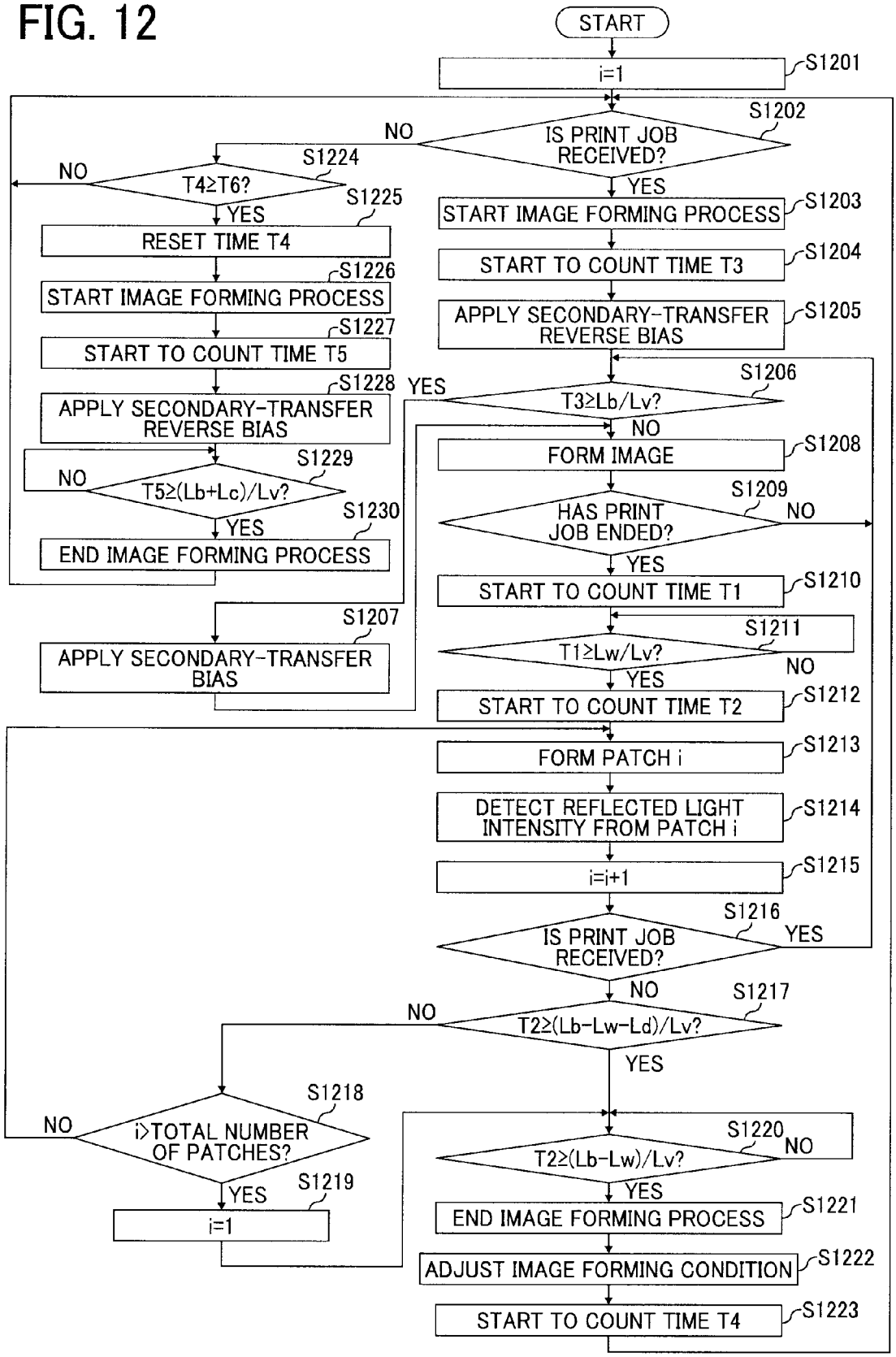
FIG. 12 is a flowchart of an operation of adjusting the image forming condition performed by the printer according to the fifth embodiment.

FIG. 11 is a block diagram for explaining the functional of an operation of adjusting the image forming condition performed by the printer 1100. The functional configuration of the printer 1100 is substantially the same as those described in the above embodiments except that a control unit 1102 included in the printer 1100 performs a different operation from those described in the above embodiments and the printer 1100 further includes a first counting unit 1101. Because the operation shown in the FIG. 12 is substantially the same as that shown in FIG. 10, only a different part is explained. The explanation about operations performed at Steps S1201 to S1222 is omitted.

The first counting unit 1101 counts an elapsed time T4 from when the image forming condition is adjusted to when a new print job is received by using the RTC. Specifically, after the adjusting unit 404 adjusts the image forming condition, the first counting unit 1101 starts to count the elapsed time T4 (Step S1223).

When the elapsed time T4 reaches a predetermined interval time, the control unit 1102 causes the intermediate belt cleaner 119 to remove the patch pattern from the intermediate transfer belt 105.

Specifically, if the receiving unit 401 does not receive a print job (No at Step S1202), the control unit 1102 determines whether an inequality T4≧T6 is satisfied where T6 is a predetermined interval time (Step S1224). If it is determined that the inequality T4≧T6 is not satisfied (No at Step S1224), the process control returns to Step S1202. On the other hand, if it is determined that the inequality T4≧T6 is satisfied (Yes at Step S1224), the control unit 1102 resets the elapsed time T4 counted by the first counting unit 1101 (Step S1225). The control unit 1102 then starts the image forming process (Step S1226).

Figure 13:
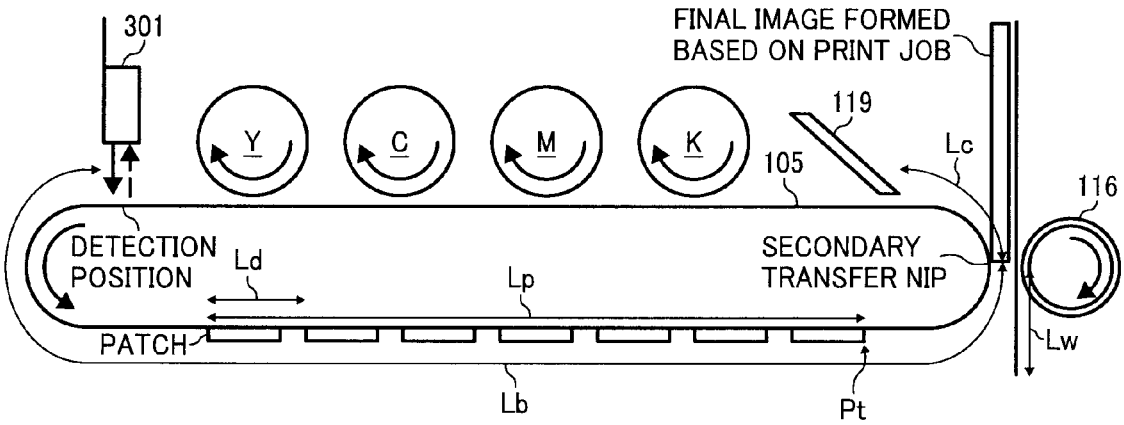
FIG. 13 is a schematic diagram for explaining an example of the patch pattern formed on the intermediate transfer belt.

The control unit 1102 starts to count an elapsed time T5 by using the RTC (Step S1227), and applies the secondary-transfer reverse bias to the secondary-transfer roller 116 (Step S1228). The control unit 1102 then determines whether an inequality T5≧(Lb+Lc)/Lv is satisfied (Step S1229). FIG. 13 is a schematic diagram for explaining an example of the patch pattern formed on the intermediate transfer belt 105. Lc is a distance between the secondary transfer nip and the intermediate belt cleaner 119 along the intermediate transfer belt 105. If it is determined that the inequality T5≧(Lb+Lc)/Lv is not satisfied (No at Step S1229), the control unit 1102 repeats determination until the inequality T5≧(Lb+Lc)/Lv is satisfied. If it is determined that the inequality T5≧(Lb+Lc)/Lv is satisfied (Yes at Step S1229), the control unit 1102 determines that the patch pattern has been removed from the intermediate transfer belt 105 by the intermediate belt cleaner 119 and ends the image forming process (Step S1230). The process control returns to Step S1202.

As described above, when the elapsed time T4 reaches the predetermined interval time, the patch pattern is removed from the intermediate transfer belt 105 by the intermediate belt cleaner 119, so that it is possible to prevent the inside of the printer from being getting dirty.

Because the function and the configuration of a printer 1400 according to a sixth embodiment of the present invention is substantially the same as those of the printer 1100, only a different part is explained. In the printer 1400, it is determined whether the image forming condition needs to be adjusted, and only if it is determined that the image forming condition needs to be adjusted, the patch pattern is formed on the intermediate transfer belt 105 after the final image is formed on the intermediate transfer belt 105 based on the print job. Thus, it is possible to save the consumption amount of toner for forming the patch pattern.

Figure 14:
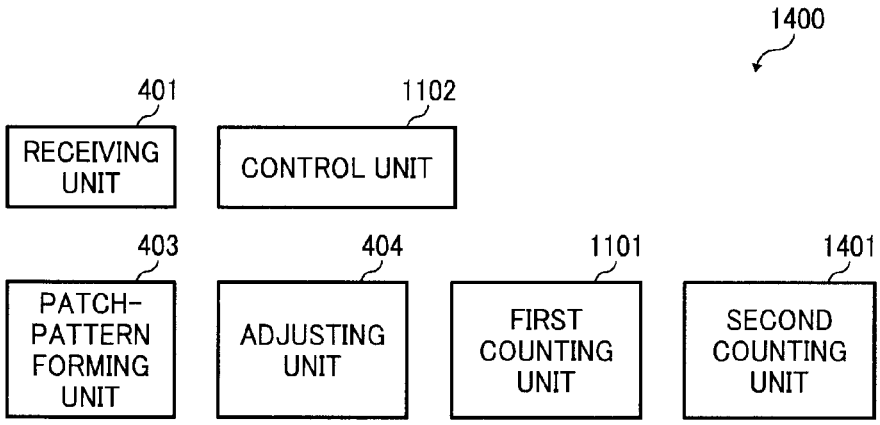
FIG. 14 is a block diagram for explaining a functional configuration of a printer according to a sixth embodiment of the present invention.
Figure 15:
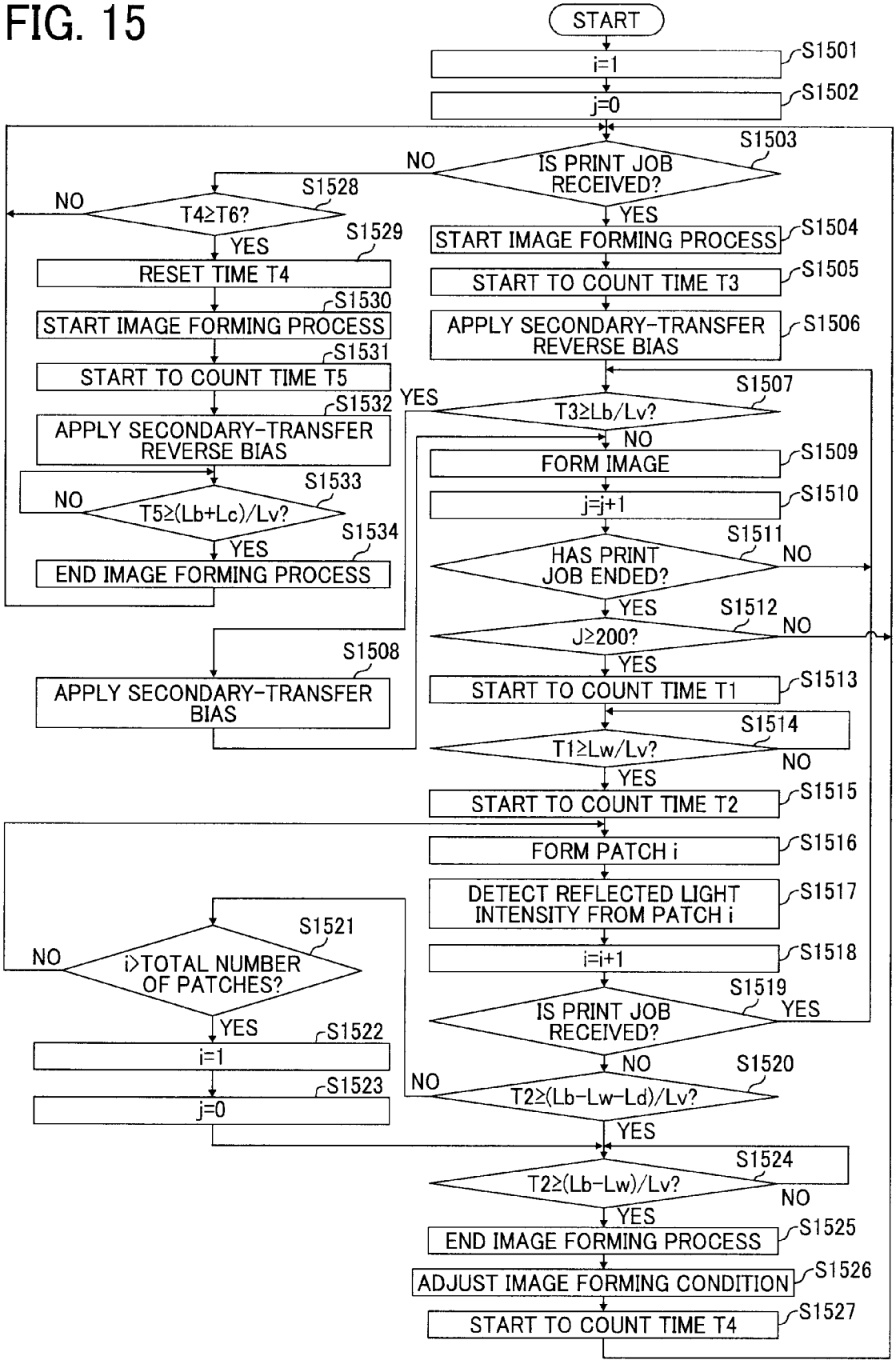
FIG. 15 is a flowchart of an operation of adjusting the image forming condition performed by the printer according to the sixth embodiment.

FIG. 14 is a block diagram for explaining the functional configuration of the printer 1400. FIG. 15 is a flowchart of an operation of adjusting the image forming condition performed by the printer 1400. The functional configuration of the printer 1400 is the same as those described in the above embodiments except that the printer 1400 further includes a second counting unit 1401. Because the operation shown in FIG. 15 is substantially the same as that shown in FIG. 12, only a different part is explained. The explanation about operations performed at Steps other than Steps S1502, S1510, S1512, and S1523 is omitted.

The second counting unit 1401 counts the number of images formed on the intermediate transfer belt 105 based on the print job. Specifically, a variable number j stored in a register (not shown) is counted up by one, so that the number of images formed on the intermediate transfer belt 105 based on the print job can be counted. Specifically, the variable number j indicates an accumulated number of print copies (the number of images formed on the intermediate transfer belt 105 based on the print job) after the image forming condition is adjusted.

Specifically, after the patch-pattern forming unit 403 substitutes the value "1" for the variable number i stored in the register (Step S1501), the second counting unit 1401 substitutes the value "0" for the variable number j stored in the register (Step S1502).

Each time an image is formed on the intermediate transfer belt 105 based on the print job, the second counting unit 1401 adds the value "1" to the variable number j stored in the register thereby counting up the accumulated number of print copies after the image forming condition is adjusted (Step S1510).

When the accumulated number of print copies reaches a first threshold ("200" in the sixth embodiment), the patch-pattern forming unit 403 causes the AIO cartridges 106K, 106M, 106C, and 106Y to form the patch pattern on the intermediate transfer belt 105.

Specifically, when the control unit 1102 determines that the entire print job has ended (Yes at Step S1511), the patch-pattern forming unit 403 determines whether the variable number j stored in the register is equal to or larger than the first threshold (Step S1512). If it is determined that the variable number j is smaller than the first threshold (No at Step S1512), it is determined that the image forming condition does not need to be adjusted, and the process control returns to Step S1503.

On the other hand, if it is determined that the variable number j is equal to or larger than the first threshold (Yes at Step S1512), the image forming condition is adjusted. When the formation of all of the patches and the detection of the light intensity have been completed for adjusting the image forming condition, the second counting unit 1401 resets the variable number j stored in the register to the value "0" (Step S1523).

As described above, when the accumulated number of print copies reaches the first threshold, the AIO cartridges 106K, 106M, 106C, and 106Y form the patch pattern on the intermediate transfer belt 105. Thus, the patch pattern can be formed only when the image forming condition needs to be adjusted, and therefore the consumption amount of toner for forming the patch pattern can be saved.

Because the function and the configuration of the printer 1400 according to a seventh embodiment of the present invention is substantially the same as those of the printer 1400 according to the sixth embodiment, only a different part is explained. In the printer 1400 according to the seventh embodiment, it is determined whether the image forming condition needs to be immediately adjusted before the entire received print job ends, and if it is determined that the image forming condition needs to be immediately adjusted, the operation of forming an image based on the print job is interrupted and the patch pattern is formed on the intermediate transfer belt 105. Thus, it is possible to prevent degradation of image quality.

Figure 16A:
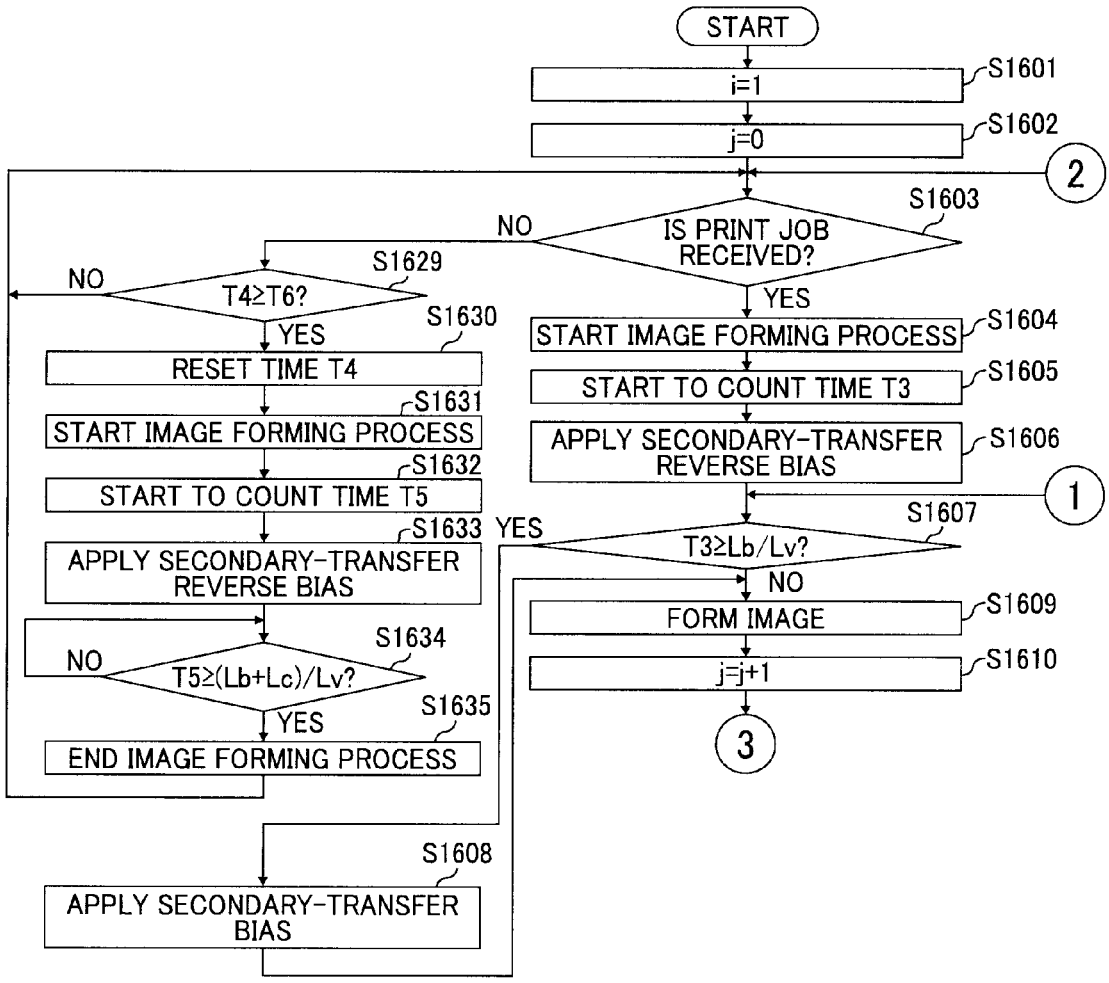
FIGS. 16A and 16B are flowcharts of an operation of adjusting the image forming condition performed by the printer according to a seventh embodiment of the present invention.
Figure 16B:
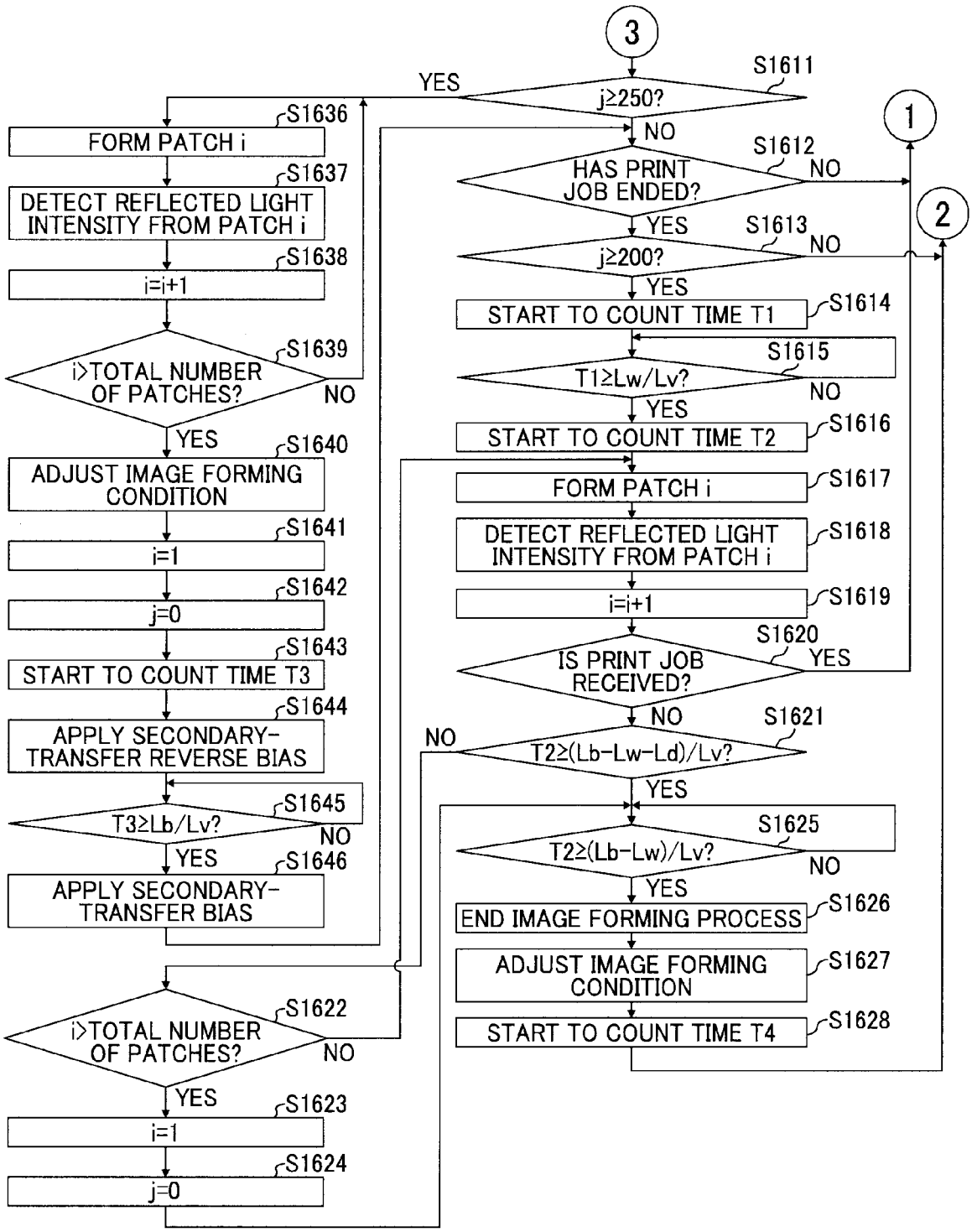

FIGS. 16A and 16B are flowcharts of an operation of adjusting the image forming condition performed by the printer 1400 according to the seventh embodiment. The flowchart shown in FIG. 16A includes the operation performed at Steps S1601 to S1610 and S1629 to S1635, and the flowchart shown in FIG. 16B includes the operation performed at Steps S1611 to S1628 and S1636 to S1646. Because the operation shown in FIGS. 16A and 16B is substantially the same as that shown in FIG. 15, only a different part is explained. The explanation about operations performed at Steps S1601 to S1610 and S1612 to S1635 is omitted.

If the accumulated number of print copies counted by the second counting unit 1401 reaches a second threshold ("250" in the seventh embodiment), the patch-pattern forming unit 403 causes the patch pattern to be formed on the intermediate transfer belt 105 before the final image is formed on the intermediate transfer belt 105 based on the print job.

Specifically, when the control unit 1102 causes the image to be formed on the intermediate transfer belt 105 based on the print job, the patch-pattern forming unit 403 determines whether the variable number j stored in the register is equal to or larger than the second threshold (Step S1611). If it is determined that the variable number j is smaller than the second threshold (No at Step S1611), it is determined that the image forming condition need not be adjusted, and the operation of forming the image is continued based on the print job.

On the other hand, if it is determined that the variable number j is equal to or larger than the second threshold (Yes at Step S1611), it is determined that the image forming condition needs to be adjusted immediately, and therefore the patch pattern is formed and the image forming condition is adjusted. Because the operation of forming the patch pattern and the operation of adjusting the image forming condition at Steps S1636 to S1642 and the operation of removing the patch pattern at Steps S1643 to S1646 are substantially the same as those at Steps S1617 to S1627 and S1605 to S1608, the explanation about these operations are omitted.

As described above, when the accumulated number of print copies counted by the second counting unit 1401 reaches the second threshold, the patch pattern is formed on the intermediate transfer belt 105 before the final image is formed on the intermediate transfer belt 105 based on the print job. Thus, if it is determined that the image forming condition needs to be adjusted immediately, the operation of forming the image based on the print job is interrupted and the patch pattern is formed on the intermediate transfer belt 105, so that it is possible to prevent degradation of image quality.

Although it is explained in the above embodiments that the present invention is applied to a printer employing an indirect transfer system in which images are transferred from the photosensitive elements to the intermediate transfer belt in a superimposed manner whereby a color image is formed on the intermediate transfer belt and the color image is transferred onto a recording medium at a secondary transfer nip, the present invention can be applied to a printer employing a direct transfer system in which color images formed on the photosensitive elements are sequentially transferred onto the recording medium conveyed on an intermediate medium (conveying belt). Furthermore, the photosensitive element can be a photosensitive drum or a photosensitive belt.

According to an aspect of the present invention, the downtime caused by the adjustment of the image forming condition can be reduced while productivity of the image forming apparatus can be maintained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a receiving unit that receives a print job from an upper-level apparatus;

an image forming unit that forms an image based on the print job;

a patch-pattern forming unit that causes the image forming unit to form a patch pattern including a plurality of patches on a conveying member;

a detecting unit that detects the patch pattern formed on the conveying member; and an adjusting unit that adjusts an image forming condition of the image forming unit based on a result of a detection by the detecting unit, wherein the patch pattern has a length substantially equal to a distance between a patch-pattern start position, which is located at a space corresponding to at least a predetermined margin of a recording medium from a position of the image, and a position of the detecting unit.

2. The image forming apparatus according to claim 1, wherein if the receiving unit receives a new print job while the image forming unit forms the patch pattern, the patch-pattern forming unit stops the image forming unit from forming the patch pattern.

3. The image forming apparatus according to claim 1, further comprising a storage unit that stores therein patch information indicating whether each of the patches has been formed, wherein the patch-pattern forming unit causes the image forming unit to form an unformed patch included in the patch pattern based on the patch information.

4. The image forming apparatus according to claim 1, further comprising:

a transferring unit that transfers the image onto the recording medium;

a cleaning unit that is arranged downstream of the transferring unit in a direction in which the patch pattern is conveyed; and a removing unit that, when the patch pattern passes the transferring unit, applies a first bias to the transferring unit, the first bias having a polarity opposite to a second bias applied to the transferring unit when the image is to be transferred onto the recording medium, and after the patch pattern passes the transferring unit, causes the cleaning unit to clean the patch pattern.

5. The image forming apparatus according to claim 4, further comprising a counting unit that counts an elapsed time from when the adjusting unit adjusts the image forming condition to when the receiving unit receives a new print job, wherein when the elapsed time reaches a predetermined time, the removing unit causes the cleaning unit to clean the patch pattern.

6. The image forming apparatus according to claim 1, further comprising a counting unit that counts number of images formed by the image forming unit based on the print job, wherein when the number of the images reaches a first threshold, the patch-pattern forming unit causes the image forming unit to form the patch pattern.

7. The image forming apparatus according to claim 6, wherein when the number of the images reaches a second threshold that is larger than the first threshold, the patch-pattern forming unit causes the image forming unit to form the patch pattern before the image forming unit forms a final image based on the print job.

8. A computer program product comprising a computer-usable medium having computer-readable program codes embodied in the medium for forming an image in an image forming apparatus that includes a receiving unit, an image forming unit, a patch-pattern forming unit, a detecting unit, and an adjusting unit, the program codes when executed causing a computer to execute:

receiving including the receiving unit receiving a print job from an upper-level apparatus;

image forming including the image forming unit forming an image based on the print job;

patch-pattern forming including the patch-pattern forming unit causing the image forming unit to form a patch pattern including a plurality of patches on a conveying member;

detecting including the detecting unit detecting the patch pattern formed on the conveying member; and adjusting including the adjusting unit adjusting an image forming condition of the image forming unit based on a result of a detection by the detecting unit, wherein the patch pattern has a length substantially equal to a distance between a patch-pattern start position, which is located at a space corresponding to at least a predetermined margin of a recording medium from a position of the image, and a position of the detecting unit.

9. The computer program product according to claim 8, wherein if the receiving unit receives a new print job at the receiving while the image forming unit forms the patch pattern at the patch-pattern forming, the patch-pattern forming includes stopping the image forming unit from forming the patch pattern.

10. The computer program product according to claim 8, wherein the program codes further causes the computer to execute storing patch information indicating whether each of the patches has been formed, and the patch-pattern forming further includes the patch-pattern forming unit causing the image forming unit to form an unformed patch included in the patch pattern based on the patch information.

11. The computer program product according to claim 8, wherein the image forming apparatus includes a transferring unit that transfers the image onto the recording medium, and a cleaning unit that is arranged downstream of the transferring unit in a direction in which the patch pattern is conveyed, and the program codes further causes the computer to execute removing including, when the patch pattern passes the transferring unit, applying a first bias to the transferring unit, the first bias having a polarity opposite to a second bias applied to the transferring unit when the image is to be transferred onto the recording medium, and after the patch pattern passes the transferring unit, causing the cleaning unit to clean the patch pattern.

12. The computer program product according to claim 11, wherein the program codes further causes the computer to execute counting an elapsed time from when the adjusting unit adjusts the image forming condition at the adjusting to when the receiving unit receives a new print job at the receiving, and when the elapsed time reaches a predetermined time, the removing further causing the cleaning unit to clean the patch pattern.

13. The computer program product according to claim 8, wherein the program codes further causes the computer to execute counting number of images formed at the image forming based on the print job, and when the number of the images reaches a first threshold, the patch-pattern forming further includes the patch-pattern forming unit causing the image forming unit to form the patch pattern on the conveying member.

14. The computer program product according to claim 13, wherein when the number of the images reaches a second threshold that is larger than the first threshold, the patch-pattern forming further includes the patch-pattern forming unit causing the image forming unit to form the patch pattern before the image forming unit forms a final image at the image forming based on the print job.

15. A method for forming an image in an image forming apparatus that includes a receiving unit, an image forming unit, a patch-pattern forming unit, a detecting unit, and an adjusting unit, the method comprising:

receiving including the receiving unit receiving a print job from an upper-level apparatus;

image forming including the image forming unit forming an image on based on the print job;

patch-pattern forming including the patch-pattern forming unit causing the image forming unit to form a patch pattern including a plurality of patches on a conveying member;

detecting including the detecting unit detecting the patch pattern formed on the conveying member; and adjusting including the adjusting unit adjusting an image forming condition of the image forming unit based on a result of a detection by the detecting unit, wherein the patch pattern has a length substantially equal to a distance between a patch-pattern start position, which is located at a space corresponding to at least a predetermined margin of a recording medium from a position of the image, and a position of the detecting unit.

* * * * *